US010892590B2

(12) United States Patent
Niederer

(10) Patent No.: US 10,892,590 B2
(45) Date of Patent: Jan. 12, 2021

(54) METHOD FOR PRODUCING A PTC HEATING ELEMENT

(71) Applicant: Eberspacher catem GmbH & Co. KG, Herxheim (DE)

(72) Inventor: Michael Niederer, Kapellen-Drusweiler (DE)

(73) Assignee: Eberspächer catem GmbH & Co. KG, Herxheim (DE)

( * ) Notice: Subject to any disclaimer, the term of this patent is extended or adjusted under 35 U.S.C. 154(b) by 260 days.

(21) Appl. No.: 15/979,674

(22) Filed: May 15, 2018

(65) Prior Publication Data

US 2018/0337506 A1 Nov. 22, 2018

(30) Foreign Application Priority Data

May 16, 2017 (DE) ..... 10 2017 208 253

(51) Int. Cl.

| | |
|---|---|
| ***H01R 43/04*** | (2006.01) |
| ***H01R 43/24*** | (2006.01) |
| ***H05B 3/24*** | (2006.01) |
| ***H05B 3/06*** | (2006.01) |
| ***H01R 43/16*** | (2006.01) |

(52) U.S. Cl.

CPC ..... *H01R 43/24* (2013.01); *H01R 43/16* (2013.01); *H05B 3/06* (2013.01); *H05B 3/24* (2013.01); *H05B 2203/017* (2013.01); *H05B 2203/02* (2013.01)

(58) Field of Classification Search

CPC ..... H01R 43/16; H01R 43/24; H05B 3/06; H05B 3/24; H05B 2203/02; H05B 2203/017

See application file for complete search history.

(56) References Cited

U.S. PATENT DOCUMENTS

| | | | | |
|---|---|---|---|---|
| 4,327,282 | A * | 4/1982 | Nauerth | H05B 3/10 219/505 |
| 5,268,665 | A * | 12/1993 | Iwao | H01C 7/02 338/22 R |
| 6,392,207 | B2 | 5/2002 | Beetz et al. | |
| 6,919,535 | B2 | 7/2005 | Uhl et al. | |
| 7,109,841 | B2 | 9/2006 | Haga et al. | |
| 7,576,305 | B2 * | 8/2009 | Zeyen | F24H 3/0429 219/520 |
| 9,161,391 | B2 | 10/2015 | Niederer et al. | |

(Continued)

FOREIGN PATENT DOCUMENTS

| | | |
|---|---|---|
| DE | 39 42 266 C1 | 3/1991 |
| DE | 10118599 | 11/2002 |

(Continued)

*Primary Examiner* — Paul D Kim

(74) *Attorney, Agent, or Firm* — Boyle Fredrickson S.C.

(57) ABSTRACT

A method is disclosed for producing a PTC heating element comprising a PTC element and contact plates which are contacted to face side surfaces of the PTC element in an electrically conductive manner such that the PTC element is, at its face side surfaces, reliably electrically contacted to contact surfaces. The contact plates are connected to one another by way of electrically insulatable bridge elements while leaving a seat free for the PTC element. The method includes deforming the contact plates to shape or form a contact projection abutting against one of the face side surfaces.

16 Claims, 7 Drawing Sheets

(56) References Cited

U.S. PATENT DOCUMENTS

| | | | | |
|---|---|---|---|---|
| 9,398,641 | B2 | 7/2016 | Bohlender et al. | |
| 10,116,015 | B2 * | 10/2018 | Baumann | H01M 10/615 |
| 10,429,099 | B2 * | 10/2019 | Bohlender | F24H 3/0429 |
| 10,485,059 | B2 * | 11/2019 | Bohlender | H05B 3/30 |
| 2008/0099464 | A1 | 5/2008 | Niederer et al. | |

FOREIGN PATENT DOCUMENTS

| | | |
|---|---|---|
| DE | 102012204433 | 9/2013 |
| EP | 2 547 171 A2 | 7/2012 |

* cited by examiner

METHOD FOR PRODUCING A PTC HEATING ELEMENT

BACKGROUND OF THE INVENTION

1. Field of the Invention

The present invention relates to a method for producing a PTC heating element with a PTC element and contact surfaces for electrically contacting the PTC element. In PTC heating elements, as are known, for example, from EP 1 253 808 A1 or EP 1 395 098 A1, respectively, an electrical conductor track typically abuts against oppositely disposed main side surfaces of the PTC element. The conductor track is commonly formed from a contact plate which is connected to a position frame, for example, sealed into the position frame.

2. Description of the Related Art

Especially with high-voltage applications in electric vehicles, it is necessary to electrically insulate the outer side of the contact plate. For this purpose, it is known from the aforementioned prior art to apply an insulation layer on the outer side of the contact plate.

PTC elements have self-regulating properties. With increasing heating, the power consumption decreases since the electrical resistance of the PTC element increases. It has therefore always been aspired to obtain good heat extraction from the PTC element. Furthermore, with PTC heating elements for the automotive industry, cost-effective production needs to be ensured. The configuration of the PTC heating element must be scalable and reliably producible within predetermined tolerance limits also in large numbers.

SUMMARY OF THE INVENTION

The present invention is based on the problem of specifying a method for producing a PTC heating element in which the PTC element is at its face side surfaces reliably electrically contacted to contact surfaces.

For solving the problem, a method having the features of claim 1 is suggested with the present invention.

In the method according to the invention, the contact plates are connected to one another by way of electrically insulating bridge elements while leaving a seat free for the PTC element. It goes without saying that several bridge elements can be used to form several seats. These bridge elements are typically provided spaced apart from each other along elongate contact plates. One or more PTC elements can be provided in each seat.

In the procedure according to the invention, the PTC element is inserted into the seat and between the contact plates. The contact plates are there so far apart from each other that the seat is dimensioned sufficiently large such that the PTC element can be inserted into the seat without being influenced by the contact plates. Only then is each contact plate deformed for obtaining a contact projection abutting against the face side surface of the PTC element.

The contact projection can be shaped during the deformation. In a pre-processing step for the sheet metal strip, the contact projection can alternatively already be shaped typically by way of punching, but not yet be deformed in the direction toward the PTC element for abutting thereagainst. It is conceivable to provide the contact plates with elongate slots through which the contact projections are cut free as strips at a boundary layer to the PTC element. During the subsequent deformation, these thin bars are deformed in the direction toward the PTC element and abutted against a face side surface of the PTC element to provide a sound electrical contact between the PTC element and the respective contact plate.

In the aforementioned embodiment, in which a contact spring bar is typically shaped on the contact plate by the preceding punching operation, the deformation of the contact spring bar for its abutment against the PTC element is preferably performed by a conically widening tool, such as a pin, which is introduced into a slot between the contact spring bar and the remainder of the material of the contact plate for deforming the contact spring bar in the direction toward the PTC element. Several pins are typically provided on a tool for deforming the contact spring bars in this manner and at the same time are introduced into the corresponding slots. This achieves a deformation of the contact spring bars in a cost-effective and reliable manner. For example, the tool can be lowered in a force-controlled manner to ensure that the contact spring bars rest with a predetermined contact pressure on the face side surface of the PTC element. When simultaneously deforming contact spring bars of different contact plates, it is additionally ensured that the PTC element is contacted identically on oppositely disposed face side surfaces.

For deforming the contact projections, the contact plates are preferably received in a tool which abuts against the outer surface of the contact plates. As a result, the forces needed for the deformation are supported so that the deformation arises on the side of the contact plates that is to be contacted with the PTC element, but not on the oppositely disposed free outer sides of the contact plates. In addition, the deformation of the contact spring bars becomes controllable, since the force possibly monitored for deforming the contact spring projections results exclusively in a deformation in the direction toward the PTC element.

According to a preferred embodiment of the present invention, the contact plates are overmolded after the deformation. An insulation layer is preferably applied to the PTC element prior to overmolding. Following this application of the insulation layer, the PTC element is typically on its main side surfaces respectively provided with an insulation layer which can be a ceramic insulation layer. The insulation layer is formed, for example, by an aluminum oxide plate. The insulation layer is preferably glued in a thermally well conductive manner onto the PTC element.

When the contact plates are overmolded, the insulation layer is sealed at the edge with plastic material. However, the largest area of the insulation layer is there left exposed, so that the completed PTC heating element with the overmolding on its outer side is substantially defined by the outer surface of the insulation layer, via which heat generated by the PTC element is given off at a high heat density.

When the contact plates are overmolded, the bridge element or bridge elements is/are usually also overmolded. They can in turn be individually connected to the contact plates by overmolding. However, the contact plates can also be plugged into seats of the bridge elements and thus connected thereto.

The overmolding of the contact plates is preferably performed using elastic plastic material, for example TPE, elastomer or duromer. One of the bridge elements, which can be formed from a hard plastic component such as polyamide, can there be provided with a sealing collar having a lamellar seal to form the PTC element as a plug-in heating element which can be inserted in a sealing manner into a plug element seat of a partition wall which separates a circulation chamber, through which the fluid to be heated flows, from a connection chamber, in which contact lugs of the PTC heating element for the electrical connection are exposed. The plastic material sealing the contact surface is preferably selected to have wetting properties to the surface of the insulation layer.

Further preferably, the contact plates are extended on one side beyond one of the bridge elements for forming said contact lugs. An electrical connection element for the PTC heating element is thus formed in a known manner by the respective contact plates.

BRIEF DESCRIPTION OF THE DRAWINGS

Further details and advantages of the present invention shall become apparent from the following description of an embodiment in combination with the drawing. Therein, the figures show different phases within the framework of the production of a PTC heating element, where.

DETAILED DESCRIPTION

Figure 1:
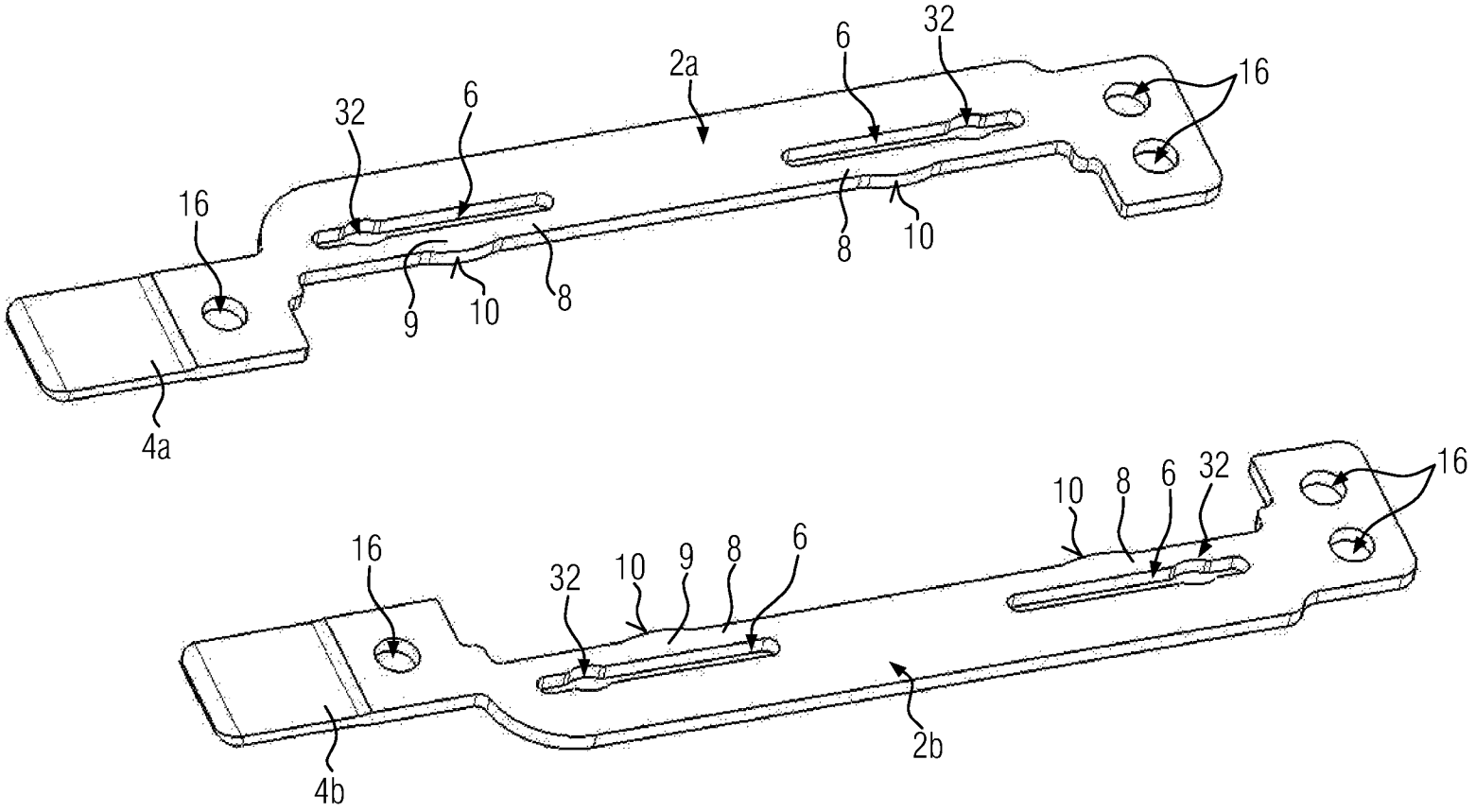
FIG. 1 shows a perspective side view of the sheet metal strips of the PTC heating element.

FIG. 1 shows a perspective side view of two sheet metal strips 2*a*, 2*b*, which are each configured identically, and which form contact lugs 4*a*, 4*b*. The sheet metal strips 2*a*, 2*b* are processed by punching. Each of the sheet metal strips 2*a*, 2*b* comprises two longitudinal slots 6 forming contact spring bars 8 which are formed as uniform segments on the sheet metal strips 2*a*, 2*b* and are each provided with a contact projection 9 forming the convex contact surface 10.

Figure 2:
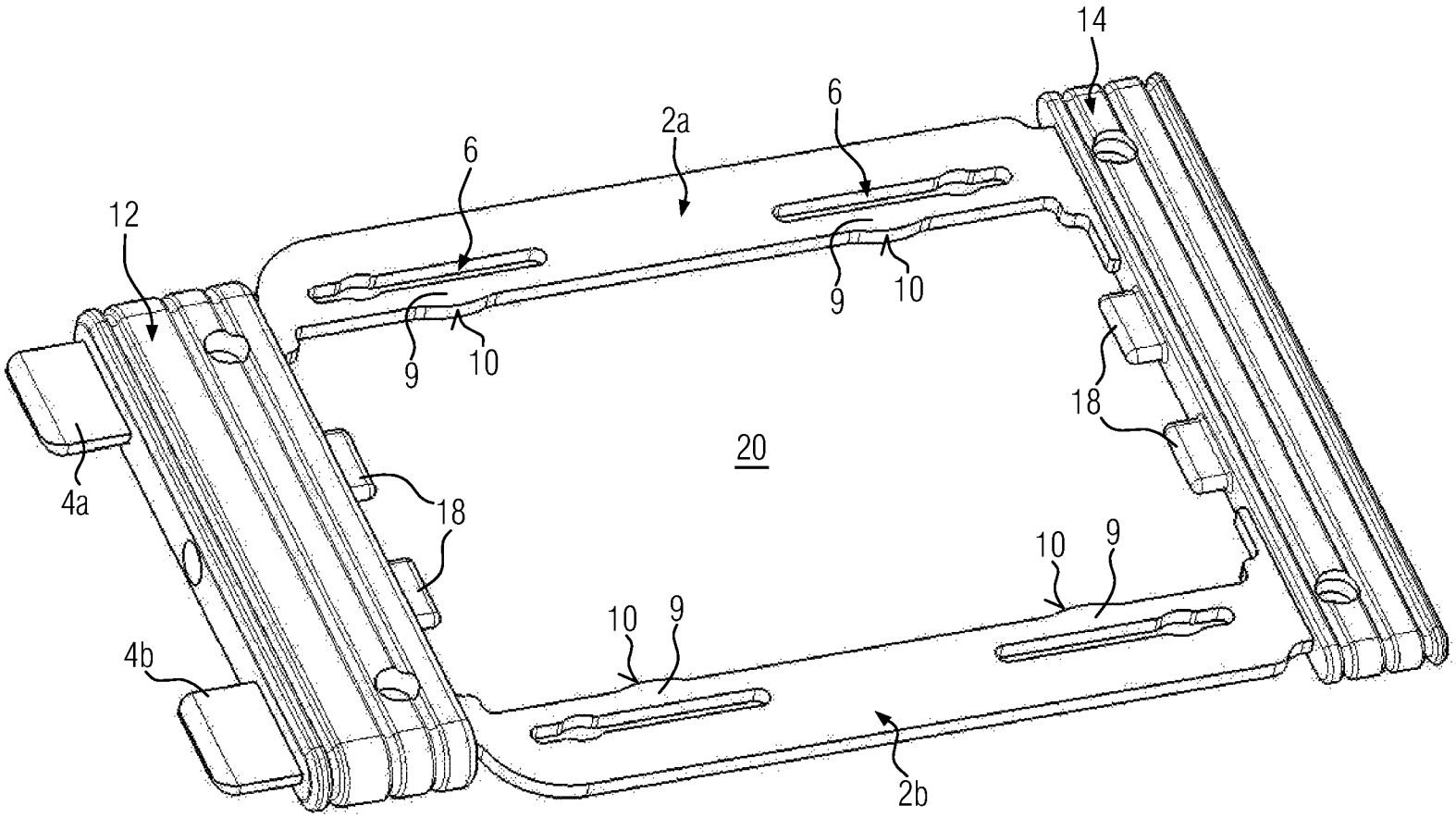
FIG. 2 shows a perspective side view of the sheet metal strips of the embodiment fitted with bridge elements.

In the illustration according to FIG. 2, the sheet metal strips 2*a*, 2*b* are connected to one another by an upper bridge element 12 and a lower bridge element 14. The bridge elements 12, 14 are made of plastic material. They are connected to the sheet metal strips 2*a*, 2*b* by overmolding. During the overmolding, bores 16 provided on the sheet metal strips 2*a*, 2*b* are partially kept free by pins formed on the overmolding tool. Only the plastic material forming the lower bridge element 14 passes a bore 16 respectively provided in the lower region (in FIG. 1, on the right-hand side) of the sheet metal strip 2*a* or 2*b*, respectively, so that an intimate positive-fit connection between the plastic material of the bridge element 14 and the sheet metal strips 2*a*, 2*b* arises. The two sheet metal strips 2*a*, 2*b* are connected to each other in a predetermined manner and spaced apart by way of the two plastic bridge elements 12, 14.

Figure 4:
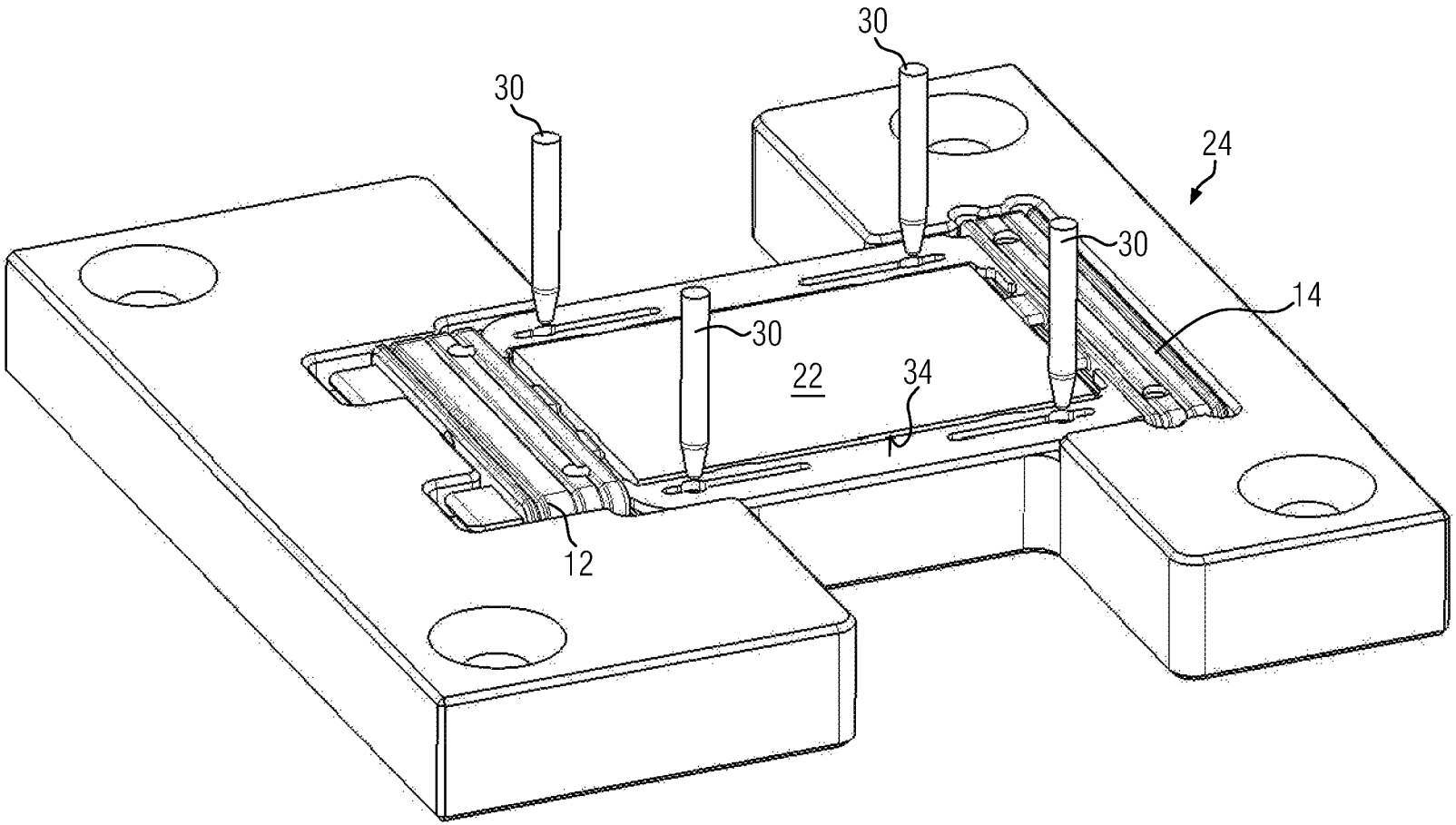
FIG. 4 shows a perspective side view according to FIG. 3 during the deformation of the contact plates.

The bridge elements 12, 14 each form spacers 18 which protrude into a seat 20 formed between the two sheet metal strips 2*a*, 2*b* and the bridge elements 12, 14. A PTC element 22 to be inserted into the seat 20 and provided in FIG. 4 is thus positioned in a predetermined manner relative to the bridge elements 18, 20, whereby the air space and creepage distances between the PTC element 22 and a support for the PTC element 22 formed by the sheet metal strips 2*a*, 2*b* and the bridge elements 12, 14 is adjustable and controllable.

Figure 3:
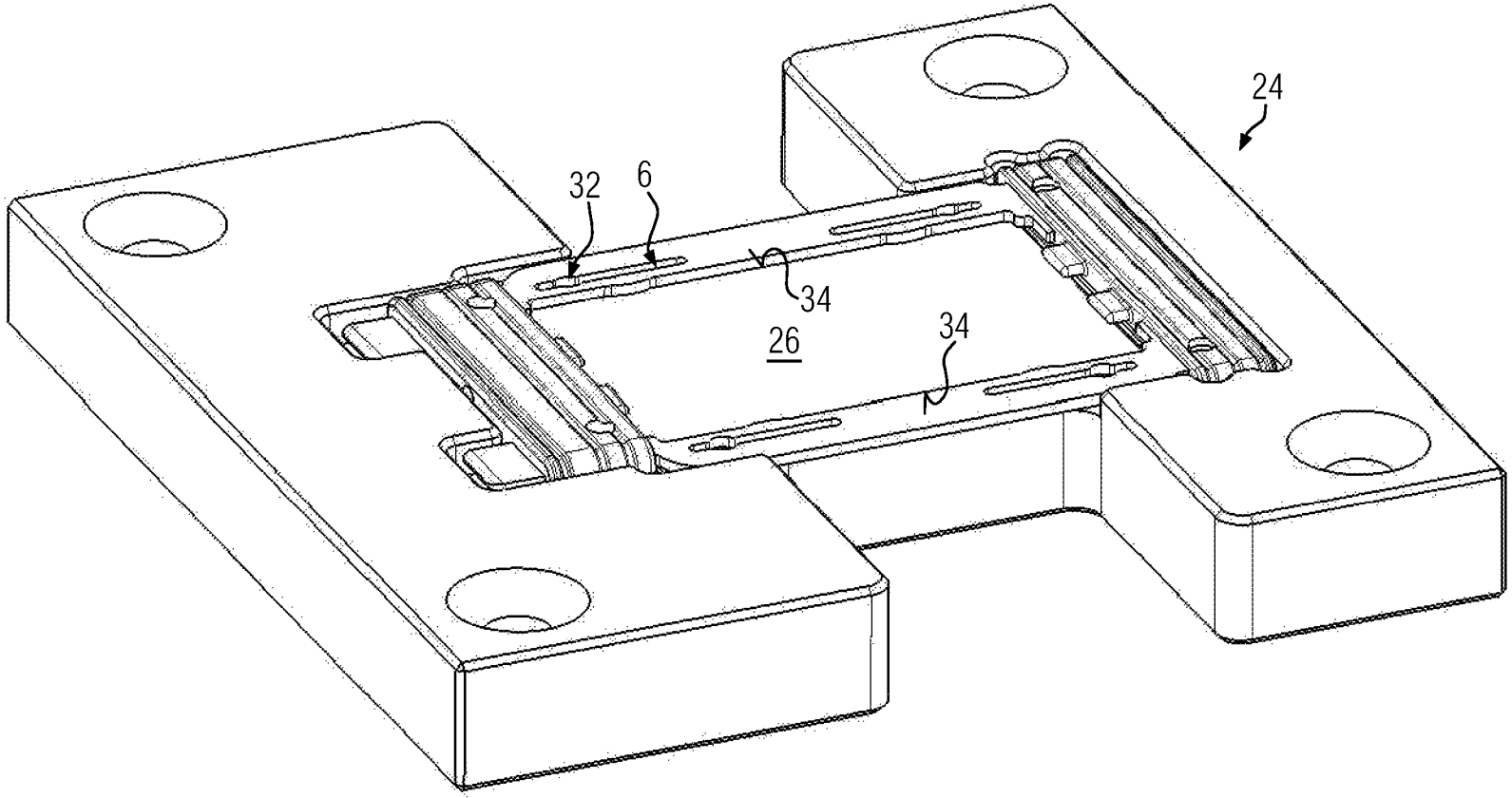
FIG. 3 shows a perspective side view of the intermediate product according to FIG. 2 provided in a tool.
Figure 6:
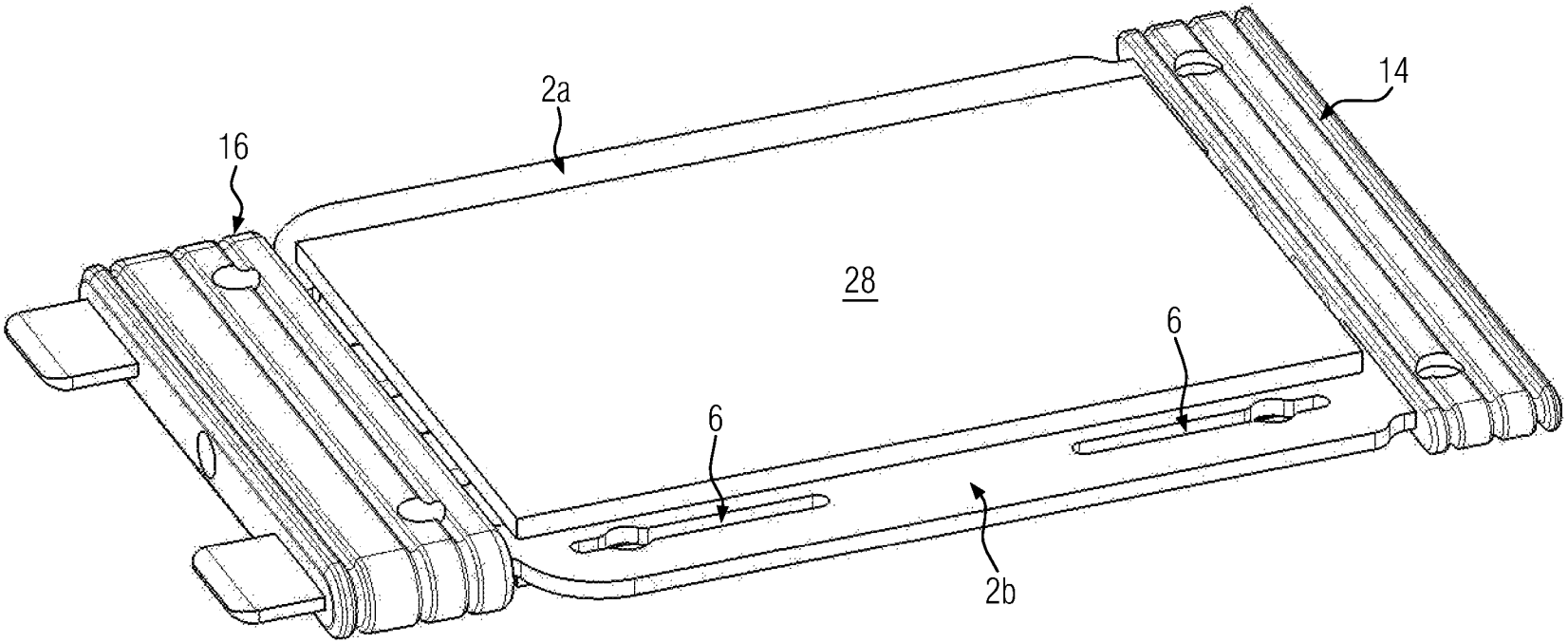
FIG. 6 shows a perspective side view of the intermediate product after the application of an insulation layer.

The intermediate product shown in FIG. 2 is shown in FIG. 3 being received in a tool 24. This tool 24 has the shape of an H and forms U-shaped seats for the lower bridge element 14 and the upper bridge element 12 together with the contact lugs 4*a*, 4*b*. These seats of the tool 20 enclose the sheet metal strips 2*a*, 2*b* at the edge. Provided between the respective seats is a central bar of the H-shaped tool 24 which forms an abutment surface for an insulation layer illustrated in FIG. 3 which is presently formed by an aluminum oxide plate 26. The intermediate product shown in FIG. 2 is placed onto this aluminum oxide plate 26 that is supported by the tool 24. The aluminum oxide plate 26 thereafter partially covers the sheet metal strips 2*a*, 2*b* and is provided spaced from the bridge elements 12, 14, as shown in FIG. 6. The insulation layer 28 placed thereon has dimensions that are identical to the insulation layer 26 in FIG. 3.

On its inner surface, the insulation layer 26 can be provided with electrically well conductive adhesive. It can be completely or partially filled with highly thermally conductive particles in order to improve thermal conductivity of the adhesive. The PTC element 22 is placed onto the surface of the insulation layer 26 thus prepared (FIG. 4). And it is now located in the seat 20.

Figure 5:
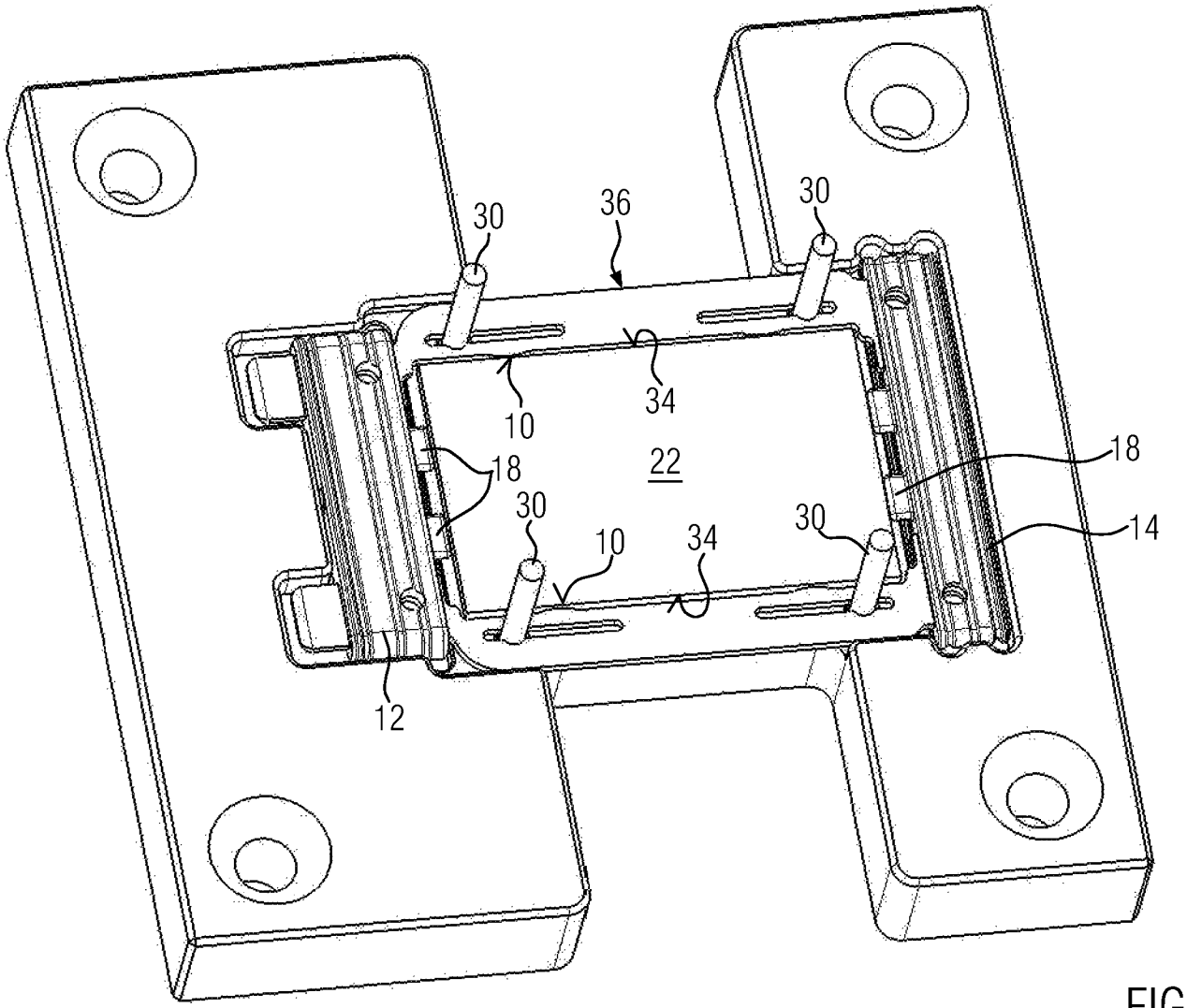
FIG. 5 shows a perspective top view according to FIGS. 3 and 4 at the end of the deformation.

Thereafter, conical pins 30 engage in the longitudinal slots 6. For this purpose, they each have an idealized circular extension 32 which can be seen in FIGS. 1 and 2 and is configured to be adapted to receive the conical end of the pin 30. The pins 30 are overall held in a uniform support element, not shown, which is movable relative to the tool 24. In the framework of lowering the pins 30 in the direction toward the sheet metal strips 2*a*, 2*b*, the pins 30 with their tapered conical end penetrate into the extension 32 to cause a deformation of the contact spring bars 8. Because the outer side of the sheet metal side 2*a*, 2*b* is prevented by the tool 24 within the U-shaped seat of the same from giving way outwardly due to the deformation imposed by the pins 30. The contact spring bars 8 are thus plastically formed inwardly. The contact surfaces 10 initially abut against face side surfaces 34 of the PTC element 22. These are the face side surfaces 34 on the longitudinal sides of the PTC element 22. The face side surfaces provided on the broadside, via which this electrical contact is established, are spaced apart from the bridge elements 12, 18 by the spacers 18. As the insertion motion progresses and after abutting the contact spring bars 8 against the face side surfaces 34, an elastic deformation of the contact spring bars 8 arises, so that the contact surfaces 10 at the end of the deformation of the contact spring bars 8 abut against the PTC elements 22 on the face side subject to a certain elastic pretension. Thereafter, the PTC element 22 is electrically connected by way of the contact surfaces 10 to the respective sheet metal strips 2*a*, 2*b* The PTC element 22 is also held by this pressure fit within a housing 36 formed by the sheet metal strips 2*a*, 2*b* and the bridge elements 12, 14 (see FIG. 5). During this process step the PTC element 22 is supported by the tool 24 with the insulation layer 26 arranged between an abutment formed by the tool 24 and the PTC element 22. Thus, the PTC element 22 is received central in height direction between the spring bars 8.

Thereafter, the pins 30 are withdrawn. The housing 36 is removed from the tool 24. Finally, the further insulation layer 28 is placed onto the PTC element 22 in order to create an intermediate product in which the oppositely disposed main side surfaces of the PCT [sic] element 22 are each covered by one of the insulation layers 26, 28. This intermediate product is shown in FIG. 6.

The intermediate product shown in FIG. 6 is then overmolded with commonly elastic plastic material. This plastic material also passes through the remaining bores 16 of the sheet metal strips 2*a*, 2*b* which are aligned with corresponding bores of the bridge elements 14, 16, so that an intimate positive-fit connection between the intermediate product according to FIG. 6 and the plastic frame 38 arises which passes through the longitudinal slots. Since the longitudinal slots 6 are recessed immediately adjacent to the insulation layers 26, 28, a reliable seal of the insulation layers 26, 28, due to the plastic material of the plastic frame 38 which passes through the longitudinal slots, also arises.

Figure 7:
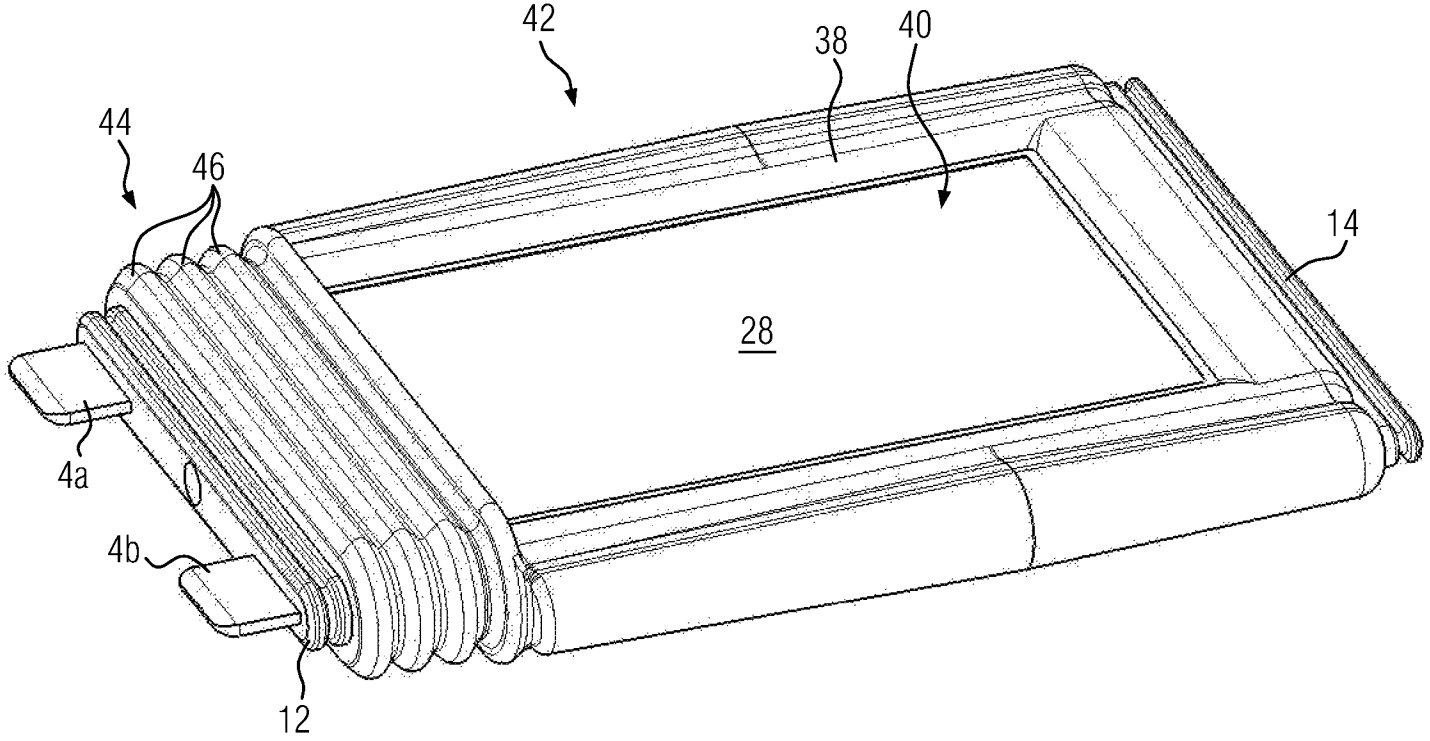
FIG. 7 shows a perspective side view after overmolding of the intermediate product.

This plastic material can be TPE, silicone, a duromer or an elastomer. Good wetting of the insulation layers 26, 28 by the respective plastic material is of particular importance. The plastic material is overmolded while omitting substantially the main side surfaces of the insulation layer 26, 28 The overmolded plastic material then results in a plastic frame which substantially leaves free the main side surfaces of the insulation layers 26, 28 and forms a window 40 in which the insulation layers 26, 28 are exposed. However, the circumferential edges of the insulation layers 26, 28 are sealed by the material of the plastic frame and a seal of the insulation layers 26, 28 against the plastic frame 38 arises accordingly. As illustrated in FIG. 7, only the contact lugs 4*a*, 4*b* project beyond the product thus produced. The bridge elements 12, 14 are only partially enveloped by the elastic material of the plastic frame 38. The lower bridge element 14 projects beyond the plastic frame 38 and forms a support from the technical plastic material of the bridge element 14 via which the PTC heating element 42 shown in FIG. 7 can be positioned on the lower side in a heater housing. On the opposite side, the plastic material of the plastic frame 38 forms a sealing collar 44 having several circumferential sealing beads 46 which can be pressed as male plug and seal elements into female seats of a partition wall in order to hold the PTC heating element 42 in a plug connection and seal it therein. The plug connection is typically provided in a partition wall which separates a circulation chamber, through which the fluid to be heated flows and in which the PTC heating element 42 is substantially provided, from a connection chamber, in which the contact lugs 4*a*, 4*b* are electrically connected. For this purpose, the connection chamber can have a printed circuit board, with which various PTC heating elements of the heater are combined to form a heating circuit and/or are energized with power current in a controlled manner. The controller can also be provided within the connection chamber.

The sealing beads 46 are provided circumferentially surrounding the plastic material of the upper bridge element 12. As a result, the contact force within the female plug element seat is improved.

The product according to the invention is characterized in that the PTC element 22 is reliably contacted with its oppositely disposed face side surfaces 34. The contact surfaces 10 of the sheet metal strips 2*a*, 2*b* are there not only in abutment against the PTC element 22 in a press-fit manner. Instead, an elastic deformation is impressed upon the contact spring bar 8 by the lateral spacing between the convex contact surface 10 and the extension 32 receiving the pin 30, with which any possible settling and/or thermal expansion within the PTC heating element 42 during operation can be compensated. The heat-generating cell with the two current-carrying sheet metal strips 2*a*, 2*b* connected to different polarities and the PTC heating element 22 are sealed fully circumferentially by the plastic frame 38, since the plastic frame 38 only leaves the insulation layers 26, 28 free.

The bridge elements 12, 14 can also be in a plugged connection with the sheet metal strips 2*a*, 2*b*. The attachment between the bridge elements 12, 14 and the sheet metal strips 2*a*, 2*b* can be effected, for example, by welding or gluing. Also, positive-fit connections are conceivable. In addition, the bridge elements 12, 14 can each be of a multipart design, where the multiple parts of a single bridge element can be joined together enclosing the sheet metal strips 2*a*, 2*b*. The sheet metal strips 2*a*, 2*b* in this joining are preferably locked in a positive-fit manner within the bridge element or bridge elements.

Furthermore, it is conceivable to provide several seats 20 one behind the other in the direction of extension of the sheet metal strips 2*a*, 2*b*. For this purpose, the sheet metal strips are each provided with several bridge elements in the longitudinal direction, where a seat is provided between each of the adjacent bridge elements.

The PTC heating element 42 illustrated is suitable as a PTC heating element in a fluid heater. Due to the plastic frame 38, there is no risk that the fluid to be heated reaches the PTC element. In this case, the sealing bead 46 is sealingly received in a partition wall, and the lower bridge element 14 protruding beyond the plastic frame 38 can be received in a receptacle recessed at the bottom of the circulation chamber. As a result, the PTC heating element 42 can be held in a predetermined arrangement and orientation within a fluid heater, as is known in principle from EP 2 607 121 B1, EP 2 440 004 B1 or EP 1 921 896 from the applicant.

What is claimed is:

1. A method for producing a positive temperature coefficient (PTC) heating element, comprising:

providing a PTC element;

providing contact plates for contacting face side surfaces of said PTC element in an electrically conductive manner;

connecting said contact plates to one another by way of electrically insulating bridge elements while leaving a seat free for said PTC element;

inserting said PTC element into said seat; and shaping a contact projection by deforming said contact plates, said contact projection abutting against one of said face side surfaces.

2. The method according to claim 1, wherein each of said contact plates is provided with a contact spring bar prior to the insertion of said PTC element into said seat, and wherein said contact spring bar of each contact plate is deformed in the direction toward said PTC element after the insertion of said PTC element into the seat.

3. The method according to claim 1, wherein said contact plates, when deforming said contact projection, are received in a tool which abuts against outer surfaces of said contact plates.

4. The method according to claim 3, wherein said tool provides a butment supporting said PTC element during the deformation.

5. The method according to claim 1, further comprising overmolding said contact plates after the deformation.

6. The method according to claim 5, wherein an insulation layer is applied to said PTC element prior to the overmolding and, wherein said contact plates and said insulation layer are enclosed at an edge by a plastic frame during the overmolding.

7. The method according to claim 1, wherein said bridge elements are connected to said contact plates by overmolding.

8. The method according to claim 7, wherein said contact plates are extended on one side beyond one of said bridge elements in order to form contact lugs.

9. A method for producing a PTC heating element that comprises a PTC element and contact plates, which are contacted to face side surfaces of said PTC element in an electrically conductive manner, the method comprising:

connecting said contact plates to one another by way of electrically insulatable bridge elements while leaving a seat free for insertion of said PTC element; and deforming said contact plates to form a contact projection configured to abut against one of said face side surfaces.

10. The method according to claim 9, wherein each of said contact plates is provided with a contact spring bar prior to the insertion of said PTC element into said seat, and wherein said contact spring bar of each contact plate is deformed in the direction toward said PTC element after the insertion of said PTC element into the seat.

11. The method according to claim 9, wherein said contact plates are received in a tool which abuts against outer surfaces of said contact plates when said contact plates are deforming said contact projection.

12. The method according to claim 11, wherein said tool provides an abutment supporting said PTC element during the deformation.

13. The method according to claim 9, further comprising overmolding said contact plates with a layer of a material after the deformation.

14. The method according to claim 13, further comprising applying an insulation layer to said PTC element prior to the overmolding; and enclosing said contact plates and said insulation layer at an edge by a plastic frame during the overmolding.

15. The method according to claim 9, wherein said bridge elements are connected to said contact plates by overmolding.

16. The method according to claim 15, wherein said contact plates are extended on one side thereof beyond one of said bridge elements in order to form contact lugs.

* * * * *